US007713042B1

(12) United States Patent
Rodgers

(10) Patent No.: US 7,713,042 B1
(45) Date of Patent: May 11, 2010

(54) ROTARY ENGINE

(76) Inventor: John Rodgers, 3808 Morningside Dr. North, Ellenton, FL (US) 34222

( * ) Notice: Subject to any disclaimer, the term of this patent is extended or adjusted under 35 U.S.C. 154(b) by 0 days.

(21) Appl. No.: 12/614,416

(22) Filed: Nov. 7, 2009

(51) Int. Cl.
*F01C 21/18* (2006.01)
*F04C 15/06* (2006.01)

(52) U.S. Cl. ..... 418/184; 418/183; 418/188; 418/185; 418/267; 123/243

(58) Field of Classification Search ..... 418/184, 418/183, 188, 185, 267; 123/243
See application file for complete search history.

(56) References Cited

U.S. PATENT DOCUMENTS

| | | | | | |
|---|---|---|---|---|---|
| 27,148 | A | * | 2/1860 | Parsons | 418/184 |
| 397,516 | A | * | 2/1889 | Powers | 418/184 |
| 741,617 | A | * | 10/1903 | Bogart | 418/184 |
| 1,597,542 | A | * | 8/1926 | Polsley | 418/184 |
| 1,953,378 | A | | 4/1934 | Vias | |
| 2,475,224 | A | * | 7/1949 | Deitrickson | 418/184 |
| 2,799,371 | A | * | 7/1957 | Osborn | 418/184 |
| 3,304,879 | A | * | 2/1967 | Hanson | 418/184 |
| 3,361,076 | A | * | 1/1968 | Davis | 418/184 |
| 3,585,973 | A | * | 6/1971 | Klover | 418/267 |
| 3,778,199 | A | * | 12/1973 | Meacham | 418/183 |
| 3,891,357 | A | | 6/1975 | Davis | |
| 4,047,856 | A | | 9/1977 | Hoffman | |
| 4,115,045 | A | | 9/1978 | Wyman | |
| 4,806,085 | A | * | 2/1989 | Costa | 418/184 |

* cited by examiner

*Primary Examiner*—Thomas E Denion
*Assistant Examiner*—Mary A Davis
(74) *Attorney, Agent, or Firm*—Dorothy S. Morse

(57) ABSTRACT

A rotary engine configured to use compressed air or high pressure steam to produce power. It has a casing with two peripheral exhaust ports each adjacent to a flattened area, a rotor having three slotted pistons, and a center valve with two opposed inlet ports that provide high pressure steam or compressed air to the pistons. Each rotor revolution produces three power strokes. Furthermore, the volume of air used for a single cycle is reduced, as a result of the air traveling through its pistons. Also, the engine stops when the vehicle it powers is at rest, and a spring inside each piston causes its angled tip to contact the rotary chamber upon start up. In addition, it is inexpensive to manufacture, as there is not much tooling needed to make the rotary engine, and it has only four moving parts, its rotor and the three pistons attached to it.

20 Claims, 9 Drawing Sheets

ROTARY ENGINE

CROSS-REFERENCES TO RELATED APPLICATIONS

None

BACKGROUND

1. Field of the Invention

This invention relates to rotary engines powered by compressed air or steam, specifically to a rotary engine using compressed air or steam that produces power more advantageously than a combustion engine. The most preferred embodiment of the present invention rotary engine has a two-part casing that houses a rotor having three equally spaced-apart vanes/pistons (hereinafter referred to as pistons without intent of limitation) secured to the rotor via slots. During use of the present invention, the rotor and its three vanes are its only moving parts. Also, the casing fits closely around the rotor and pistons, which are centered within the casing. In addition, the free ends of the pistons are angled to form a tip, and each piston further contains an internally positioned spring that biases the angled piston tip against the interior surface of the casing to create a reactionary force upon start up. The pistons divide the interior space within the casing into three working chambers, and each revolution of the rotor within the casing produces three power strokes. The pistons are hollow and receive high pressure steam or compressed air from a center fixed valve having two inlet ports in opposed positions from one another. Thus, as the pistons rotate within the casing, injection of high pressure steam or compressed air into each piston occurs twice during one revolution of the rotor. Each piston also contains an opening adjacent to its angled free end through which the high pressure steam or compressed air used to produce power is delivered into the working chamber behind it. The delivery/end openings in all pistons are identically oriented away from the direction of rotor rotation.

The interior surface of the present invention casing has two arcuate lobes separated by two opposed flattened areas across which the pistons also move during their rotation. Furthermore, two exhaust ports are formed through the casing in opposed positions, each adjacent to a different one of the flattened areas and in a location that allows each piston to move across it prior to reaching the adjacent flattened area. Shortly after a piston passes one of the flattened areas and before the piston ahead of its has moved across the next approaching exhaust port to open it, the piston passing the flattened area will advance into a position where it is in fluid communication with the center valve through inlet ports, wherein it will begin to receive high pressure steam or compressed air from the center valve and release it into the working chamber behind it. However, as the piston continues to rotate, pressure continues to build in the working chamber in front of it, as the piston ahead of it will not yet have uncovered the exhaust port associated with the second flattened area (that is in an opposed location from the first flattened area). Once the exhaust port becomes uncovered, the advancing piston begins to move the steam or air from the previous power cycle through the exhaust port, giving a power boost to the piston ahead of it. Shortly thereafter, the piston ahead of it will come into fluid communication with the center valve via the opposing inlet port, and begin to release high pressure steam or compressed air into the working chamber ahead of it causing pressure to build in that working chamber until the piston ahead of it uncovers the next approaching exhaust port.

When the present invention is used to power a motor vehicle, it will stop when the vehicle it powers is at rest, such as during a temporary stop at a traffic light. In addition, the present invention rotary engine has many advantages over a combustion engine, including but not limited to, the present invention is inexpensive to manufacture as there is not much tooling needed to make it; increasing horsepower simply involves increasing the width dimensions of the casing, rotor, and pistons; no crankshaft or connecting rods are needed when it is used to power a vehicle; it runs silently; compressed air adds no fuel weight/load to the vehicles it powers; it uses a small volume of air per cycle because the air is able to travel through its pistons; no wasteful energy is needed to cool it; no flammable fuel is used; it has breathable exhaust; no starter is required; and it instantly starts in cold weather. Also, air compressors associated with the present invention rotary engine can be electrically and/or mechanically driven. Applications are varied and many, including providing more reliable and economical power for motorized vehicles than is possible with a combustion engine. A small and compact present invention rotary engine has sufficient power to run a four passenger vehicle at 80-mph, with added horsepower easily achieved for larger vehicles by widening working chambers, piston, and rotor.

2. Description of the Related Art

Prior art rotary engines are known to comprise triangular-shaped rotors and vaned rotors, and many have their rotors mounted on eccentric shafts. Also, the rotor housings used in prior art rotary engines are known to comprise circular interior surfaces and two-lobed epitrochoidal interior surfaces. The rotary mechanism disclosed in U.S. Pat. No. 3,891,357 to Davis (1975) includes an interior surface having two arcuate lobes separated by two opposed flattened areas, as is found in the present invention. However, it also has differing structure to include an eccentric shaft/rotor relation, cooling nozzles 92 in ends walls 22 and 24 that provide a stream of cooling liquid to cool the rotor, exhaust ports 102 also through the end walls 22 and 24, and a gas inlet 100 through each of the opposed flattened areas. Furthermore, the Davis invention has structure configured to overcome oil sealing problems encountered with Wankel-type engines. The fixed center valve with opposing inlet ports, the peripheral exhaust ports, and the three-vane structure of the present invention are not disclosed as a part of the Davis invention. U.S. Pat. No. 4,047,856 to Hoffman (1977) discloses a rotary steam engine having a triangular-shaped hollow rotor, an eccentric shaft/rotor relation, radial grooves 72a-c and 73a-c in fluid communication with inlet ports 82 and 83 that help to conduct pressure fluid from the hollow rotor to the cavity lobes 20 and 21, and exhaust passages 80 and 81 through the housing wall. The present invention has no similar grooves and no eccentric shaft/rotor relation, and the Hoffman invention has no fixed center valve with opposing inlet ports, the peripheral exhaust ports, and the three-vane structure critical to the present invention. U.S. Pat. No. 4,115,045 to Wyman (1978) further discloses a rotary motor with spring-biased seals on the outer circular periphery of its rotor 12. Its rotor 12 has a hub 10, twenty-four radial spokes, and a circular rim 26. Multiple working chambers are defined by the seals, and a series of steam inlet and exhaust steam outlet pairs communicated with the chamber as the rotor is rotated by expansion of live steam against the radial spokes 24. Although both have vaned rotors, many differences exist between the Wyman motor and that of the present invention including the number of vanes and the number and positioning of inlet ports and exhaust ports.

Although important differences exist between it and the present invention, the rotary motor thought to be the closest to the present invention is the rotary motor disclosed in U.S. Pat. No. 1,953,378 to Vias (1934). The Vias invention comprises two adjacently positioned rotor housings having back-pressure eliminating ports that are able to move trapped fluid from one paired housing into the other according to need. Each housing also has one rotor with two vanes, and each vane having an expansion spring that constantly maintains it in engagement with the periphery of the housings working chamber (see page 1, lines 75-77). Thus, although the Vias motor has vanes with spring biasing similar to that used in the present invention, it does not teach the remainder of the present invention. Important differences in structure between the present invention and the Vias invention is that the present invention does not teach a paired housing structure with back-pressure eliminating ports, and the present invention rotor is centered within its casing, not eccentrically disposed therein. Also, the Vias motor has a cylindrical working chamber 17 with a circular periphery (see page 1, line 50 and FIGS. 3-4), while the present invention has an interior surface with two semi-circles separated by two opposed flattened areas, and in addition, its inlet ports and exhaust ports have different locations from that in the Vias motor. Also in the Vias invention, each rotor is formed with a centrally located circular exhaust chamber 23 (see page 1, lines 81-82). In the Vias invention, its intake ports 26/27 are formed through cylindrical members 16 and 16a (see FIGS. 2-4), its outlet ports 24/25 are formed through end head members 10 (see FIG. 2), and its exhaust chamber 23 is centrally located (see FIG. 4). In the present invention the opposite occurs, and a fixed valve having two opposed inlet ports is centrally located and two exhaust ports each located adjacent to a different one of the two opposed flattened area across which the free angled end of the pistons collectively move before they reach the adjacent flattened area. No other rotary engine is known to have the same structure, function in the same manner, or provide all of the advantages of the present invention.

BRIEF SUMMARY OF THE INVENTION

It is the primary object of this invention to provide an inexpensive and high efficiency rotary engine that uses compressed air or high pressure steam to produce power more advantageously than a combustion engine. It is also an object of this invention to provide a rotary engine that does not use flammable fuel. Further objects of this invention are to provide a rotary engine with only four moving parts, does not require a catalytic converter to meet environmental standards, and has breathable exhaust. It is also an object of this invention to provide a rotary engine that only uses a small volume of air per cycle, and has no wasteful energy lost in cooling it. Other objects of this invention are to provide a rotary engine that does not require a starter, instantly starts in cold weather, and does not run when the vehicle it powers has come to a temporary stop, such as at a stoplight. It is also an object of this invention to provide a rotary engine that runs silently. It is a further object of this invention to provide a rotary engine with an approximate 300-degree power stroke.

As described herein, properly manufactured and used, the present invention provides a rotary engine that can use compressed air or high pressure steam to produce power, and further produces three power strokes for each revolution of its rotor. Furthermore, the volume of air used for a single cycle of the present invention is less, because the air travels through the pistons/vanes. Its casing has a two-lobed working chamber, with the two lobes separated from one another by two opposed flattened areas. In addition, two exhaust ports are each adjacent to a different one of the flattened areas, three spring-biased and equally spaced-apart pistons depend from a rotor, and a center fixed valve with two inlet ports that provide high pressure steam or compressed air to each of the three pistons/vanes twice during one revolution of the rotor, resulting in an approximate 300-degree power stroke for each revolution of the rotor. The engine stops when the vehicle it powers is at rest, and the expansion spring in each piston/vane provides contact (a reactionary force) of the tip of the angled free end of each piston/vane with the interior surface of the two-lobed rotor casing upon start up. In addition, the present invention rotary engine is inexpensive to manufacture as there is not much tooling needed to make the rotary engine, it runs silently, it uses a small volume of air per cycle and has no wasteful energy lost in cooling it, no flammable fuel is used, its exhaust is breathable, no starter is required, it instantly starts in cold weather, and there are only four moving parts, its rotor and the three pistons/vanes attached to it via equally spaced-apart slots in the rotor. Multiple present inventions (using hydraulic fluids, compressed air or high pressure steam) can be placed side-by-side to increase torque. In addition, no crankshaft or connecting rods are needed to power a vehicle, and when compressed air is used, it is quiet during its operation. Furthermore, use of compressed air does not add any fuel weight to the vehicle it powers, adding to its fuel economy. The vanes/pistons of the present invention can be hardened stainless steel, although its rotor is preferably made from hardened bronze. The present invention is more reliable and economical than a combustion engine, the torque is high for a small engine, and it has a power stroke 3 times in 360 degrees. Thus, many advantages are provided by the present invention over combustion engine use.

While the description herein provides preferred embodiments of the present invention rotary engine, the examples provided should not be construed as limiting the scope of the present invention. For example, it is within the contemplation of the present invention to incorporate variations other than those shown and described herein, such as variations in the thickness dimension of the working chambers; the number of present invention motors that can be used in concert to provide power; the materials from which the casings, springs, and fixed valve are made; the number and size of fasteners used to secure the two halves of casing together; and the size of the piston's fuel delivery opening. Thus, the scope of the present invention rotary engine should be determined by the appended claims and their legal equivalents, rather than being limited to the examples given.

COMPONENT LIST IDENTIFYING REFERENCE NUMBERS USED IN THE DRAWINGS

2—rotary engine

Figure 1:
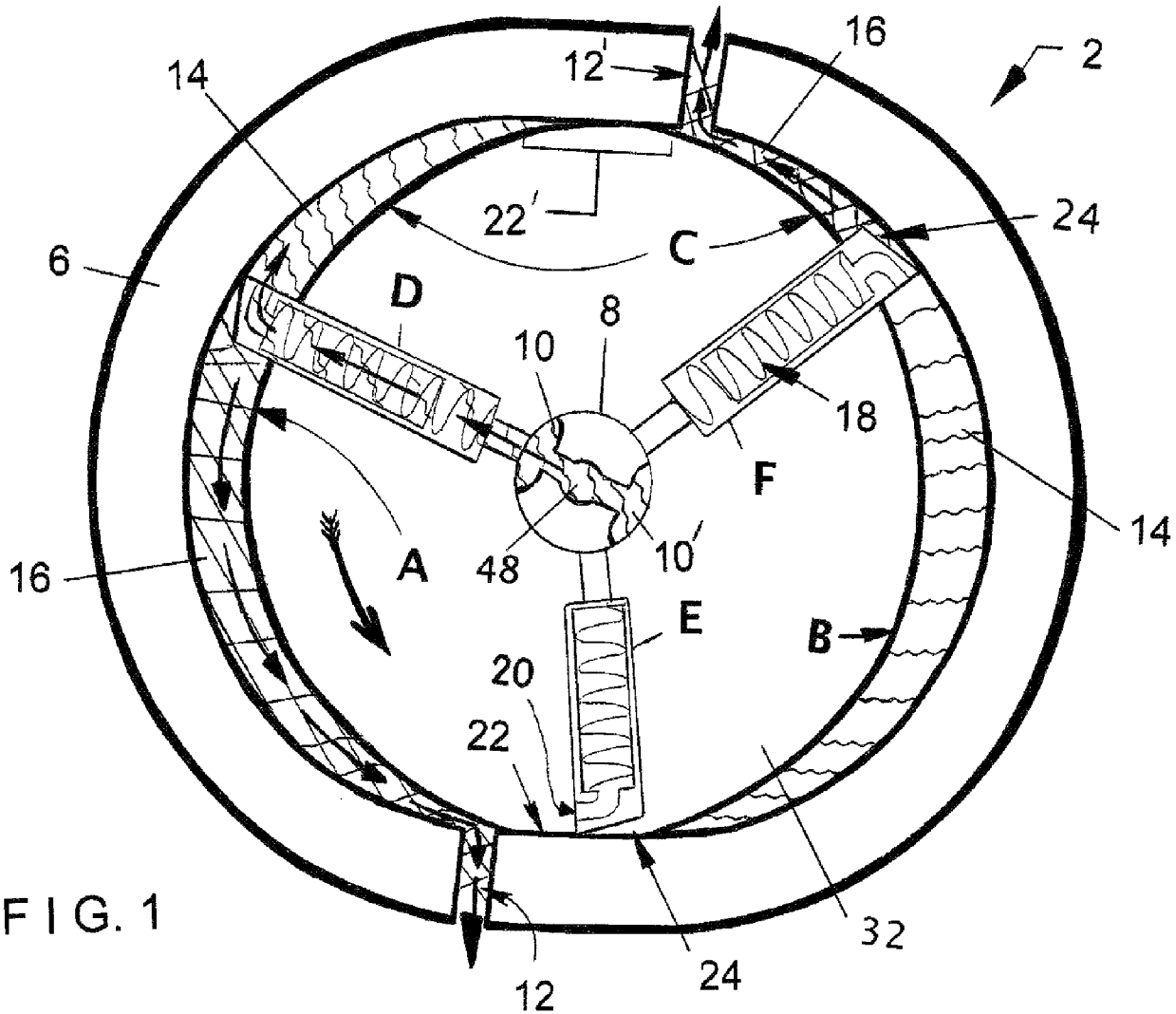
FIG. 1 is a schematic view of a power stroke in the most preferred embodiment of the present invention rotary engine and showing three pistons under counterclockwise rotation within a space bounded by a casing having two peripheral exhaust ports therein, with three working chambers defined between the three rotating pistons, an expansion spring in each of three pistons, and a fixed center valve connected to two opposed inlet ports, and further with exhaust present being marked with interconnecting lines, while the compressed air or high pressure steam present is marked with substantially parallel rippled lines.

4—piston (also marked as D, E, and F in FIG. 1 for discussion purposes)

6 and 6'—the two pieces that together form the casing within which rotor 32 and pistons 4 rotate (preferably made from two pieces of hardened bronze that are joined together by multiple fasteners 26)

8—fixed center valve used to deliver compressed air or high pressure steam 14 to inlet ports 10 and 10' (non-rotating and connected to tubing 58)

10 and 10'—central inlet ports in fluid communication with fixed center valve 8

12 and 12'—peripheral exhaust ports through the casing made from casing pieces 6 and 6' (positioned adjacent to one of the flattened areas within the casing so that pistons pass over the exhaust port before moving across the associated flattened area)

14—high pressure steam or compressed air

16—exhaust

18—expansion spring

20—delivery opening in piston 4 below connecting tube 42 (the openings 20 in all pistons 4 connected to the same rotor 32 will be oriented in like direction and location relative to casing pieces 6 and 6' and rotor 32)

22 and 22'—opposed flattened areas in casing pieces 6 and 6' (with one adjacent to each exhaust port 12 or 12)

24—angled clearance between the slanted bottom surface of each piston 4 and the inside wall of the adjacent casing piece 6 or 6'

26—fastener for use in connecting casing pieces 6 and 6' together so as to provide a secure and leak proof connection between them

28—holes in casing pieces 6 and 6' for fasteners

30—receiving chamber in piston 4 for spring 18

32—rotor having slots 54 each used to receive one piston 4

34—mounting bracket (example of one type of mounting bracket that can be used to secure casing pieces 6 and 6' in a fixed location during use)

36—dowel used to secure casing pieces 6 and 6' together
38—drive shaft connected to rotor 32
40—center bore or hole through casing pieces 6 and 6' that is used for receiving fixed valve 8
42—connecting tube in piston 4 providing fluid communication between receiving chamber 30 and delivery opening 20
44—angled tip on the free end of piston 4 that engages the interior surfaces of casing pieces 6 and 6'
46—45-degree chamfer in end of piston 4 adjacent to fixed valve 8 (reduces interference with spring 18 on start-up)
48—central hole in fixed valve 8 through which high pressure steam or compressed air 14 is delivered to inlet ports 10 and 10' (also preferably has a threaded opening 56 configured for secure connection to a steam/air delivery tubing 58)
50—extension outwardly-depending from casing 6 with a through bore dimensioned to receive drive shaft 38
52—bore through casing 6 dimensioned for receiving drive shaft 38
54—slot in rotor 32 used for receiving a piston 4 (marked as R, S, and T in FIG. 6 for discussion purposes)
56—threaded opening leading to central hole 48 in fixed valve 8
58—tubing connected to the central hole 48 in fixed valve 8 via threaded opening 56, and which is used to deliver high pressure steam or compressed air 14 to inlet ports 10 and 10' (which then travels through rotating pistons 4 into working chambers A, B, and C)
60—fastener used to maintain valve 8 within the center bore 40 in casing 6'
62—thickened central area depending outwardly from rotor 32 that engages or depends from drive shaft 38 (it also has a bore/opening 40 that houses the interior most portion of fixed valve 8)
64—hole/bore extending between slot 54 and the center hole 40 in rotor 32
A, B, and C—working chambers in FIG. 1 defined by pistons 4, rotor 32, and casing pieces 6 and 6' (marked as A, B, and C for discussion purposes)
a—angle that is preferably 28-degrees and related to the optimal positioning of inlet ports 10 and 10' relative to exhaust ports 12 and 12'

DETAILED DESCRIPTION OF THE INVENTION

Figure 2:
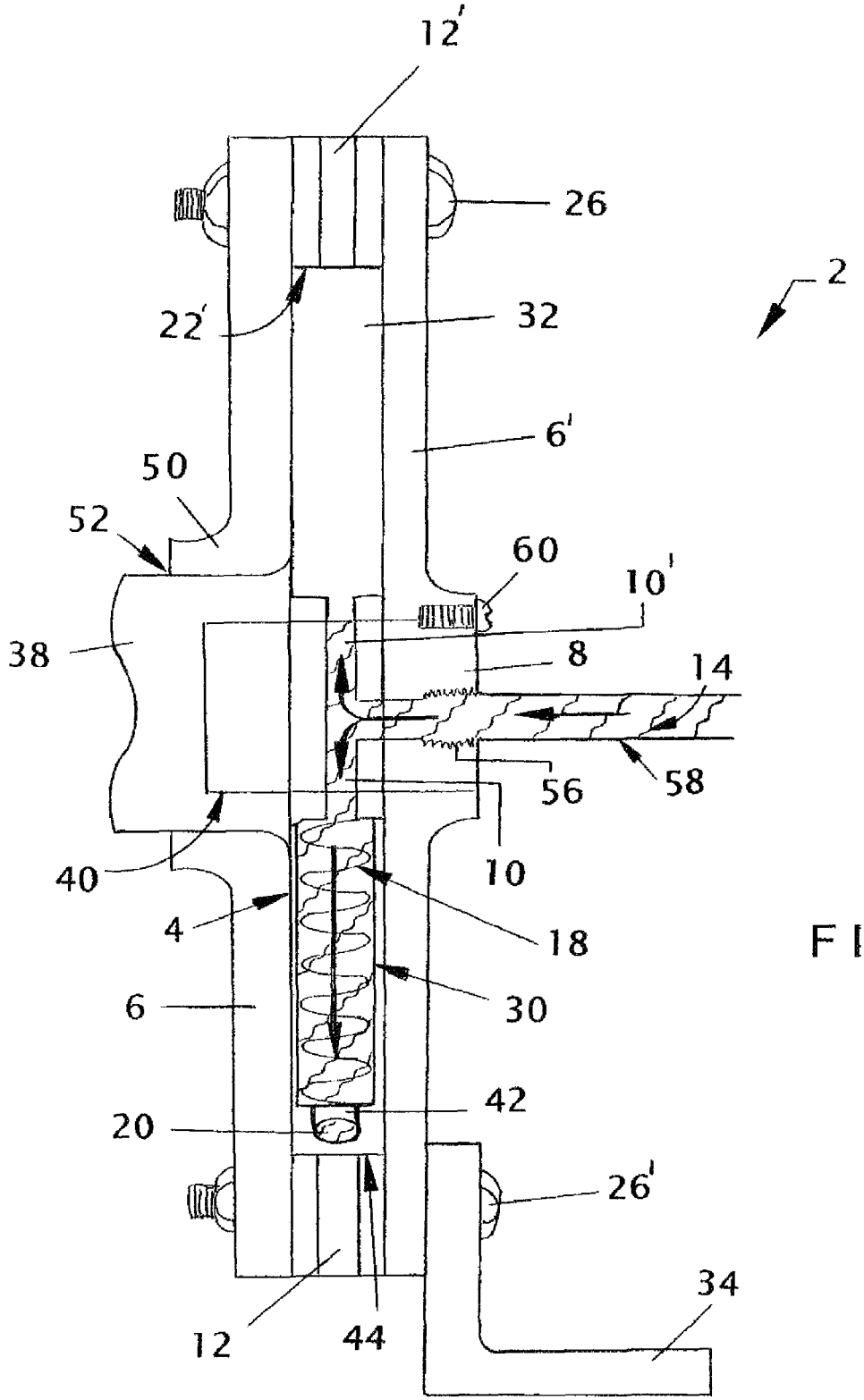
FIG. 2 is a sectional view of the most preferred embodiment of the present invention showing the narrow width of the space between opposed casing pieces in which the rotor and pistons move, fasteners connecting the casing pieces together, a mounting bracket attached to one of the casing pieces, a drive shaft secured through an opening in one casing, and the fixed valve secured through an opening in the opposed casing piece, and further with a steam/air delivery tube having threaded connection to the fixed valve, while the compressed air or high pressure steam present in the delivery tube, the two inlet ports, and one piston is marked with substantially parallel rippled lines.
Figure 3:
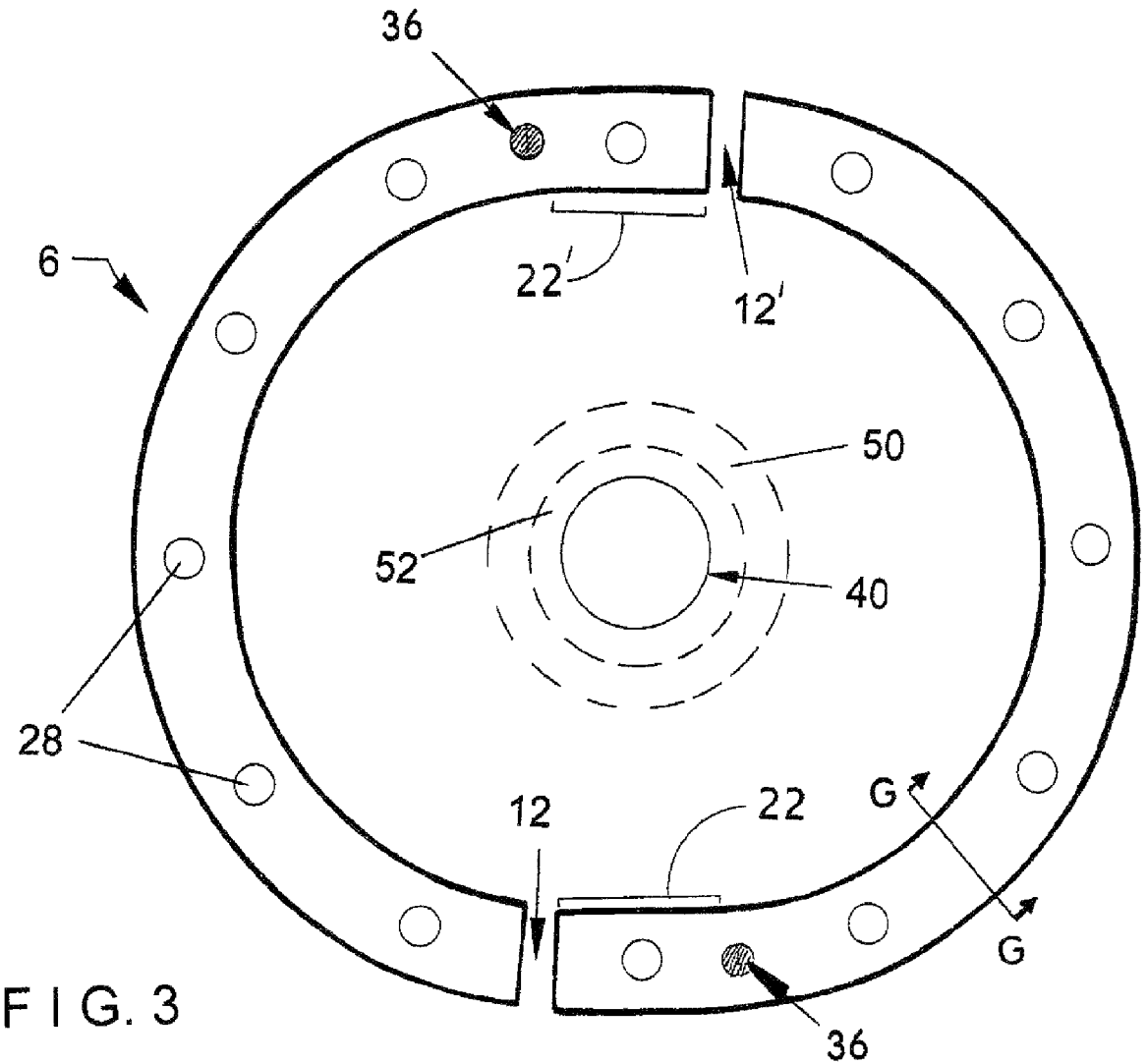
FIG. 3 is a front view of one of the casing pieces in the most preferred embodiment of the present invention showing opposed flattened areas each adjacent to a different one of the two peripheral exhaust ports present, multiple perimeter fastener holes used for securing the two casing pieces together, two dowels also used for connecting the casing pieces together, broken lines identifying the central positioning of an extension behind the casing piece and outwardly-depending from it through which a drive shaft is inserted for connection to the rotor, broken lines also showing the bore through the drive shaft receiving extension, in addition to a solid circular line centrally in the casing piece that identifies a center opening/bore used to receive the fixed/non-rotating valve that in combination with inlet ports serially introduces air/steam into the three working chambers defined by the rotor, springs, and three pistons between the two joined casing pieces adjacent to the interior surfaces of both lobes, with a section line G-G also marked on one part of the casing piece.
Figure 4A:
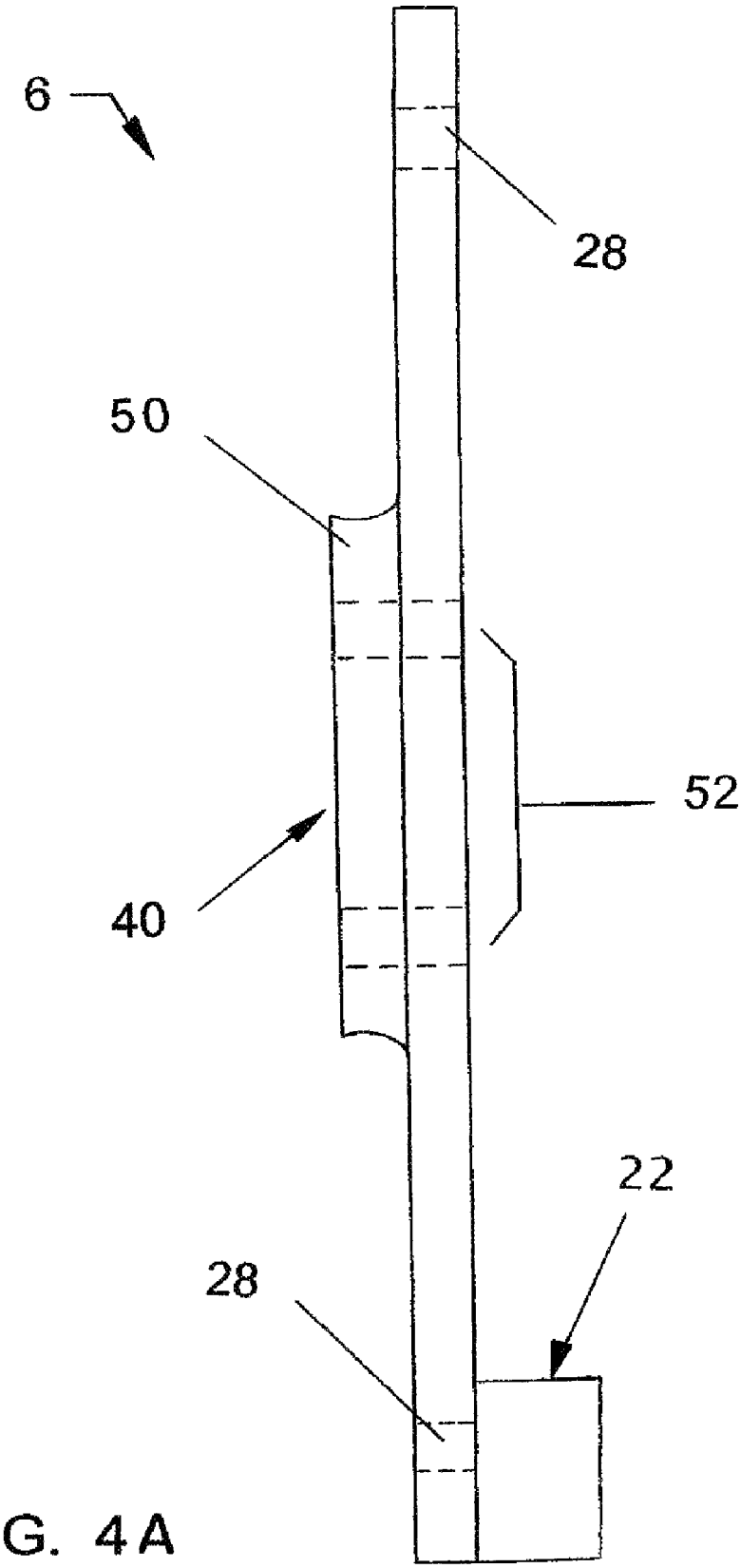
FIG. 4A is side view of the casing piece shown in FIG. 3, with the drive shaft receiving extension, its central bore, the center opening/bore used to receive the fixed/non-rotating valve, two fasteners holes, and the location of one of the flattened areas all being illustrated.
Figure 4B:
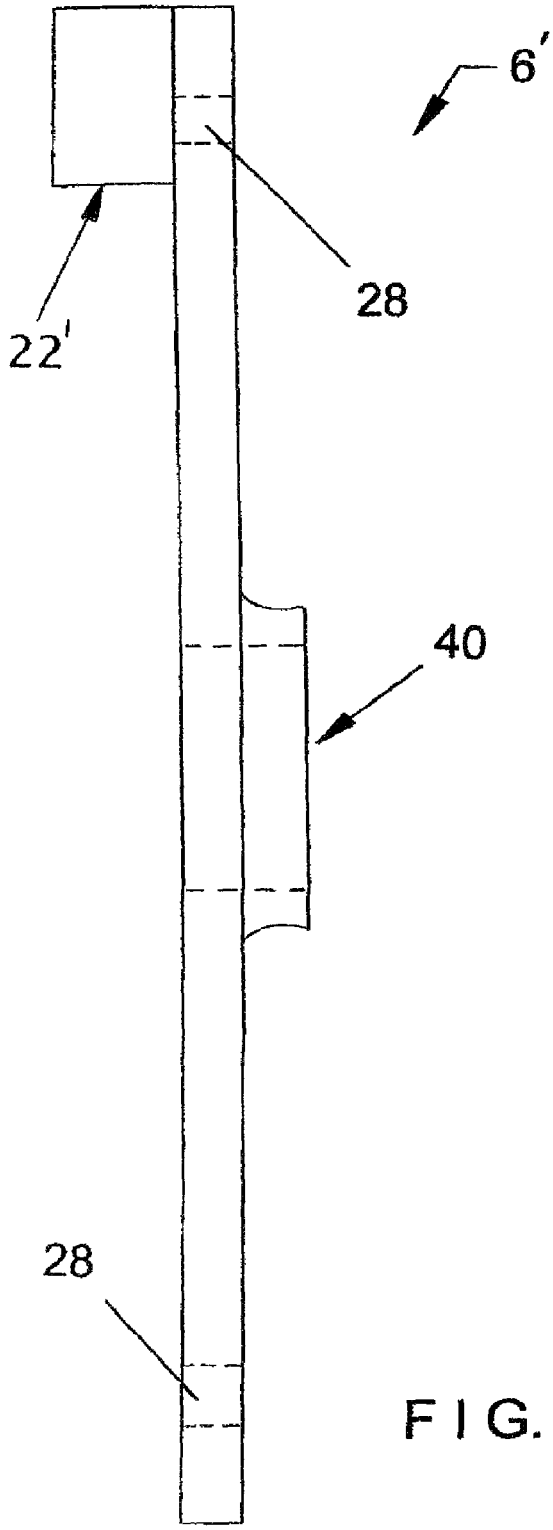
FIG. 4B is side view of the casing piece shown in FIG. 3, with a thickened central area having a central bore configured and sized to receive the fixed valve used to introduce air/steam into the working chambers, two fasteners holes, and the location of one of the flattened areas all being illustrated.
Figure 5:
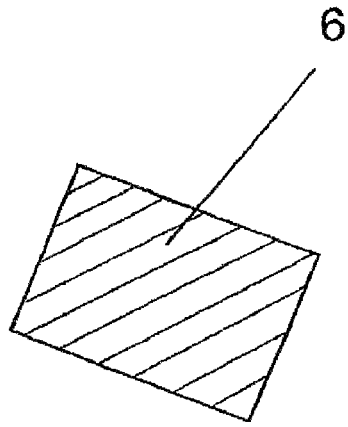
FIG. 5 is sectional view along the G-G line in FIG. 3, showing the solid construction of the casing piece shown in FIG. 3.
Figure 6:
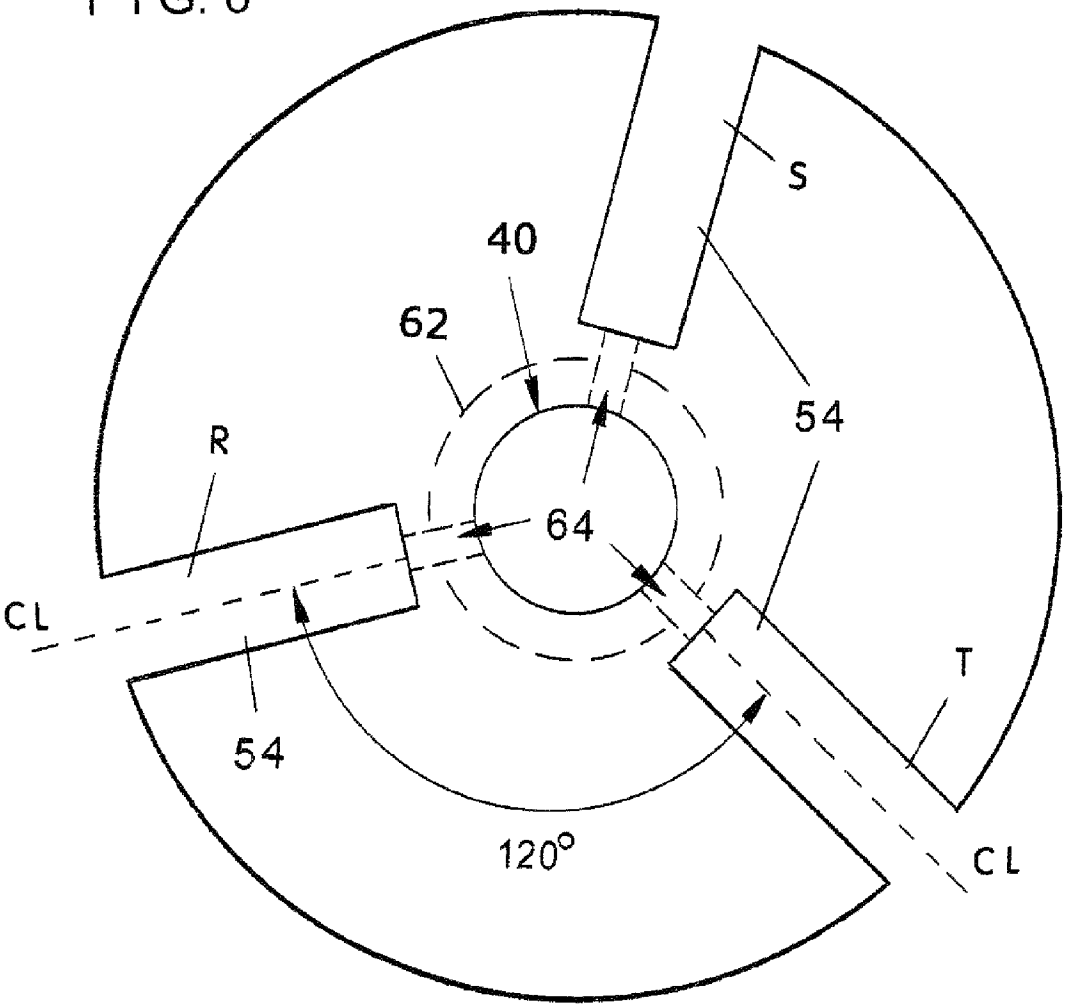
FIG. 6 is a front view of a rotor usable as a part of the most preferred embodiment of the present invention and showing three equally spaced-apart slots each used to receive a different one of the pistons, broken lines identifying a thickened central area behind the rotor and extending outwardly from it to engage from the drive shaft, or depend from it, and solid lines indicating the receiving bore/hole for the fixed valve.
Figure 7:
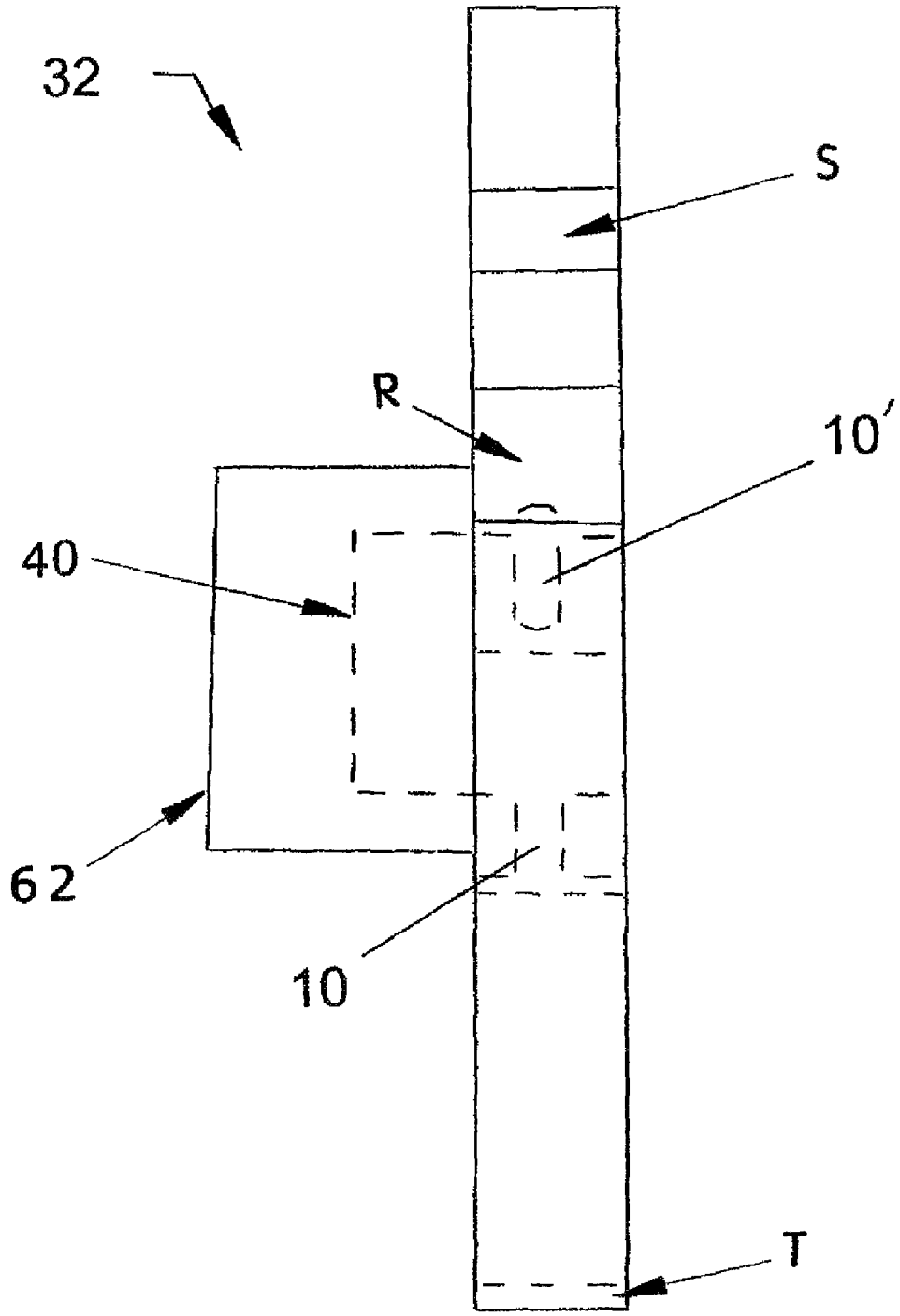
FIG. 7 is a side view of the rotor shown in FIG. 5 showing the thickened central area with a central bore configured and sized to receive the drive shaft, with broken lines indicating the receiving bore/hole for the fixed valve.
Figure 9:
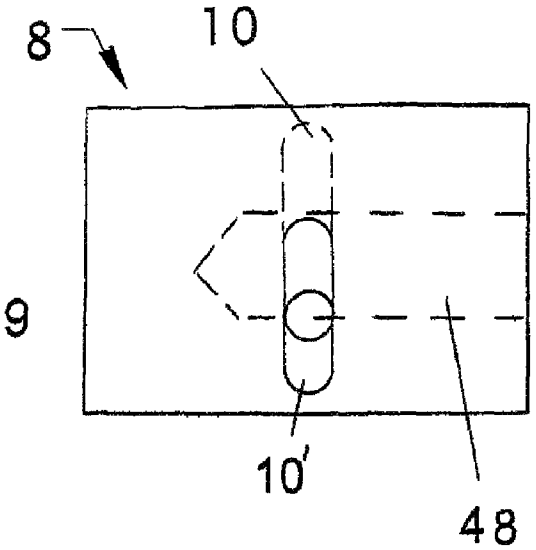
FIG. 9 is a side view of the fixed center valve shown in FIG. 8 with the central hole used for fluid communication with a source of high pressure steam or compressed air shown intersecting with inlet ports 10 and 10'.
Figure 10:
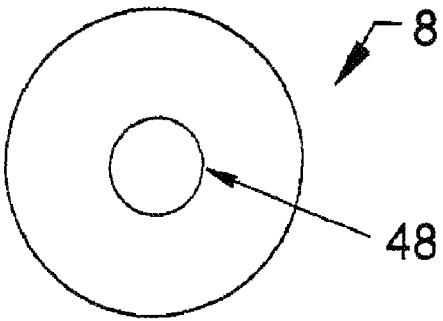
FIG. 10 is a front view of the fixed center valve shown in FIG. 8 and its central hole used for fluid communication with a source of high pressure steam or compressed air.
Figure 8:
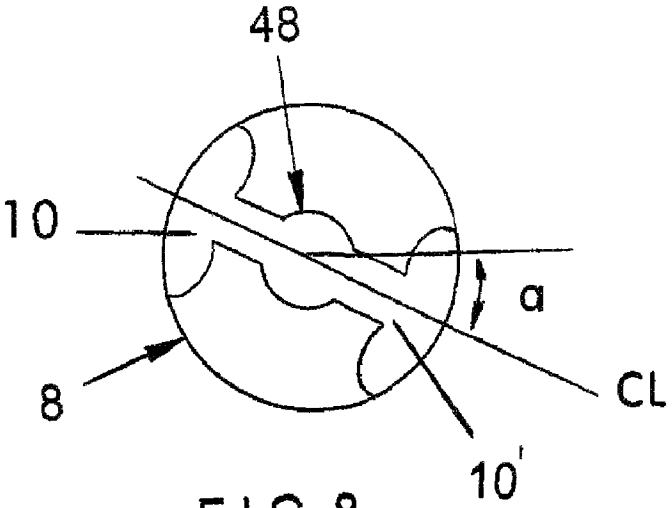
FIG. 8 is a front view of a fixed valve usable as a part of the most preferred embodiment of the present invention, with a central hole used for fluid communication with a source of high pressure steam or compressed air, two opposed inlet ports in fluid communication with the central hole that deliver steam/air to rotating pistons, and an angle marked by the letter "a" that indicates the orientation needed for the inlet ports relative to the flattened areas of the casing for optimal working efficiency of the rotary engine.
Figure 12:
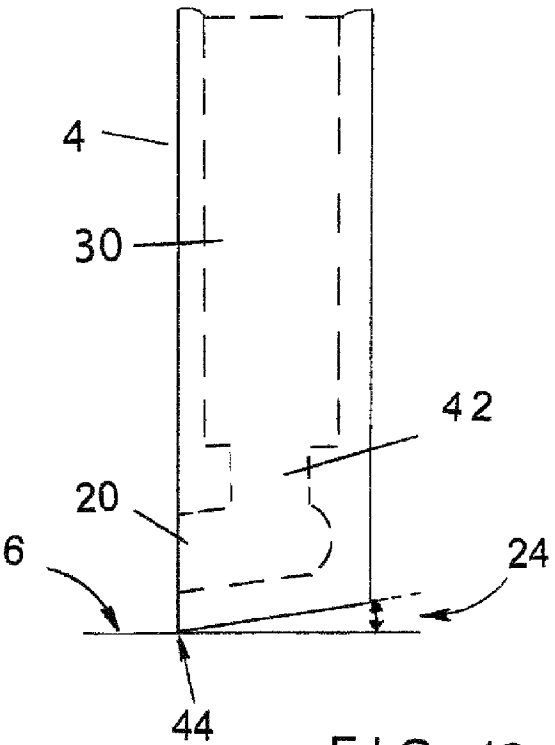
FIG. 12 is a side view of the piston in the most preferred embodiment of the present invention rotated 90-degrees from the piston shown in FIG. 11, and showing the angled tip at the bottom end of the piston as it engages the interior wall of the casing, the angled clearance between the slanted bottom surface of the piston and the interior wall of the casing, the receiving chamber for an expansion spring, a steam/air delivery opening near the angled tip, and the connecting tube providing fluid communication between the receiving chamber and the delivery opening.
Figure 11:
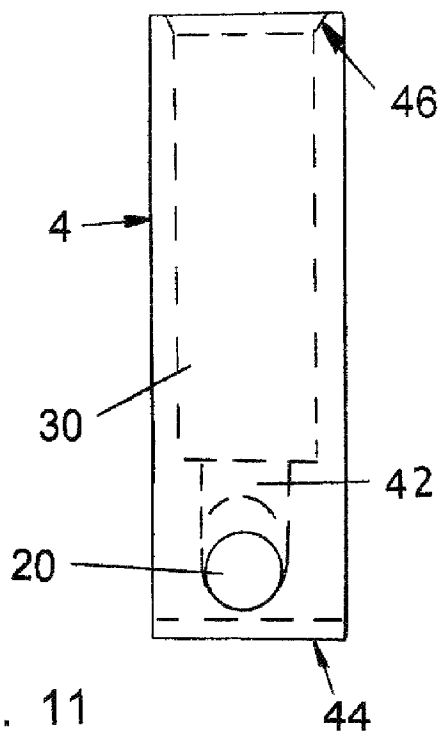
FIG. 11 is a front view of a piston usable as a part of the most preferred embodiment of the present invention, which is inserted into one of the slots in the rotor, and showing a chamfer at the top end of the piston, the angled tip at the bottom end of the piston that engages the interior wall of the casing as the piston rotates, the receiving chamber for an expansion spring, a steam/air delivery opening near the angled tip, and the connecting tube providing fluid communication between the receiving chamber and the delivery opening.
Figure 13:
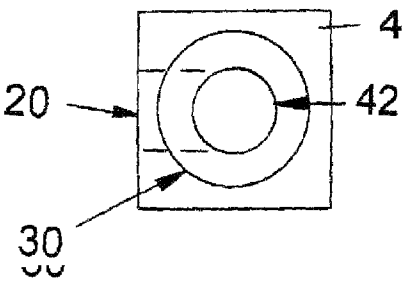
FIG. 13 is an end view of the piston shown in FIG. 11 showing the receiving chamber for an expansion spring, a steam/air delivery opening near the angled tip, and the connecting tube providing fluid communication between the receiving chamber and the delivery opening.

The present invention rotary engine 2 can use compressed air or high pressure steam 14 to produce power more advantageously than a combustion engine. Each revolution of the present invention rotor 32 and pistons 4 produces three power strokes. Furthermore, the volume of air 14 used for a single cycle of the present invention rotary engine 2 is less, since the compressed air 14 travels through its pistons/vanes 4 (also marked as D, E, and F in FIG. 1 to facilitate the description herein). Its casing is made from two casing pieces 6 and 6' that are joined together via fasteners 26, and it also has two exhaust ports 12 and 12' each adjacent to one of the flattened areas 22 and 22' that are a part of the casings interior surface against which the angled tips 44 of the pistons 4 make contact. Flattened areas 22 and 22' are in opposed positions from one another; with three spring-biased and equally spaced-apart pistons 4 inserted into slots 54 in a rotor 32 positioned for rotation within the casing made from casing pieces 6 and 6'. The present invention rotary engine 2 also has a center valve 8 in fluid communication with two opposed inlet ports 10 and 10' that provide high pressure steam or compressed air 14 (distinguished visually in FIG. 1 by substantially parallel rippled lines) to the hollow pistons/vanes 4 wherein each revolution of rotor 32 produces three power strokes. Also, rotary engine 2 stops when the vehicle (not shown) that it powers is at rest, and the springs 18 located within the pistons/vanes 4 provide contact between them and the casings interior surface (a reactionary force) upon start up. In addition, rotary engine 2 is inexpensive to manufacture as there is not much tooling needed to make rotary engine 2. Also, rotary engine 2 runs silently, it uses a small volume of air 14 per cycle and has no wasteful energy lost in cooling it, no flammable fuel is used and its exhaust 16 is breathable, no starter is required and rotary engine 2 instantly starts in cold weather, and there are only four moving parts, its rotor 332 and the three pistons/vanes 4 attached to it. FIG. 1 shows the relative positioning of high pressure steam or compressed air 14 and exhaust 16 during a power stroke in the three identified working chambers (marked as A, B, and C for descriptive purposes) of the most preferred embodiment of the present invention rotary engine 2, as the rotor 32 and pistons 4 rotate in a counterclockwise direction. In contrast, FIG. 2 shows a sectional view of the rotary engine 2 in FIG. 1 and the narrow width of the space created between casing pieces 6 and 6' used for the rotation of rotor 32 and the pistons 4 inserted into its slots 54. In addition, FIG. 3 shows casing 6 and the preferred positioning of exhaust valves 12 and 12', flattened areas 22 and 22', and fastener holes 28. FIGS. 4A, 4B, and 5 also show side and sectional views of casing pieces 6 and 6'. Furthermore, FIGS. 6 and 7 show the preferred structure for rotor 32 and pistons 4, while FIGS. 8-10 show preferred structure for fixed center valve 8 and the opposed inlet ports 10 and 10' that are in fluid communication between fixed center valve 8 and the rotating pistons 4. Finally, FIGS. 11-13 show preferred structure for pistons/vanes 4 (hereinafter 'pistons 4' without any intention of limitation), the angled clearance 24 between the end surface of each piston 4 and the interior surface of casing pieces 6 and 6', and the opening 20 in each piston 4 through which high pressure steam or compressed air 14 is introduced into the working chambers D, E, and F defined by rotor 32, casing pieces 6 and 6', and pistons 4. Although the components shown in FIGS. 1-13 represent the most preferred embodiment of the present invention, some variation thereof is contemplated and considered to also be within the scope of the present invention. Therefore, one should consult the appended claims for a determination of the full scope of the present invention rotary engine 2.

FIG. 1 is a schematic view of a power stroke in the most preferred embodiment of the rotary engine 2, which shows a rotor 32 and three pistons 4 (further individually marked by the letters D, E, and F for descriptive purposes) positioned for rotation relative to the interior space made from the joining of two similar casing pieces 6 and 6' (casing piece 6 is shown in FIG. 1) that are secured to one another with multiple fasteners 26 (see FIG. 2) each inserted through a different fastener hole 28 (see FIG. 3). FIG. 1 also shows pistons 4, rotor 32, and casing piece 6 further defining three working chambers A, B, and C that are adjacent to the interior surface of casing piece 6, and further with piston D located so that it is in fluid communication with a fixed center valve 8 via inlet port 10, wherein high pressure steam or compressed air 14 (marked by substantially parallel rippled lines) is able to flow through piston D and into working chamber C. Neither piston E or piston F are shown in FIG. 1 to be in fluid communication with the opposed inlet valve 10', although due to the counterclockwise rotation for pistons 4 indicated by the large arrow in FIG. 1, fluid communication between piston E and inlet valve 10' is imminent. In addition, FIG. 1 shows high pressure steam or compressed air 14 (distinguished visually by substantially parallel rippled lines in chambers B and C) before its compression by the next advancing piston 4 (E or F), which is imminent in working chamber B by approaching piston E. In contrast in FIG. 1, exhaust 16 is visually distinguished by the use of crossed lines and spaced-apart arrows that lead to and through exhaust ports 12 and 12', as shown in working chambers A and C, with pistons D and F respectively moving exhaust 16 toward exhaust ports 12 and 12'. Furthermore, as shown in FIG. 1, piston D will continue to deliver high pressure steam or compressed air 14 into working chamber C via opening 20 near its angled surface on its free end, until it reaches a comparable position to that shown for piston F in FIG. 1 relative to the opposing inlet port 10, where fluid communication with the fixed center valve 8 has ceased. FIG. 1 also shows the angled/slanted free ends of pistons D, E, and F that provide angled clearance 24 between each piston 4 and the interior surface of casing pieces 6 and 6'. In addition, FIG. 1 shows each piston D, E, and F having an expansion spring 18 that biases the angled tip 44 of piston D, E, or F against the interior surface of casing pieces 6 and 6' to create a reactionary force upon start up of rotor 32. FIG. 1 further shows the flattened areas 22 and 22' over which the pistons D, E, and F pass after closing the working chamber (A, B, or C) in front of it to fluid communication with an exhaust port 12 or 12'. The drive shaft 38 (shown in FIG. 2) and which connected to (or depends from) rotor 32, is not illustrated in FIG. 1 as it would be behind rotor 32. Applications for the present invention rotary engine 2 are varied and many, including providing more reliable and economical power for motorized vehicles than is possible with a combustion engine. Examples of relative dimensions used to construct a working prototype of the present invention rotary engine 2, which would be able to power a four passenger car up to 80 mph, are presented in a subsequent paragraph herein below. The width dimensions of the rotor 32, pistons 4, and casing pieces 6 and 6' can be varied, and if widened will increase the horsepower of rotary engine 2.

FIG. 2 is a sectional view of the most preferred embodiment of the present invention rotary engine 2. FIG. 2 shows fasteners 26 and 26' securing casing piece 6 to casing piece 6' (although in FIG. 3 one can see additional fastener holes 28 that are used to receive additional fasteners 26 that also help to secure casing piece 6 to casing piece 6'). FIG. 2 further shows a mounting bracket 34 connected to fastener 26', as an example of one type of mounting that is contemplated for rotary engine 2. However, it should be understood that it is not intended for the type of mounting (bracket or otherwise) used for rotary engine 2 to be limited to that shown in FIG. 2. In addition, FIG. 2 shows a drive shaft 38 extending through casing piece 6, and the fixed center valve 8 extending through casing piece 6'. FIG. 2 also shows peripheral exhaust ports 12 and 12' at the top and bottom of the illustration, with flattened area 22' marked between exhaust port 12' and rotor 32. When viewing FIG. 1, one can see the angled top of piston E against flattened area 22 and not extending beyond the perimeter edge of rotor 32, while the expansion springs 18 in pistons D and F cause them to become extended beyond the perimeter edge of rotor 32 so that their angled tips 44 can reach the arcuate interior surfaces of the two opposed lobes formed between flattened areas 22 and 22'. FIG. 2 shows no visible clearance between rotor 32 or piston 4 and casing pieces 6 and 6', with the mounting of rotor 32 between casing pieces 6 and 6' requiring a close fit therebetween so that high pressure steam or compressed air can become further compressed to cause a power stroke in working chambers A, B, and C by the advancement of rotating pistons 4, however, the clearance between rotor 32 or piston 4 and casing pieces 6 and 6' must be sufficient to allow rotational movement of pistons 4 and rotor 32 between casing pieces 6 and 6). In addition, FIG. 2 shows the delivery opening 20 near the angled tip 44 of piston 4, with substantially parallel rippled lines and a longitudinal arrow pointing toward delivery opening 20 representing high pressure steam or compressed air 14 flowing through piston 4 for delivery via opening 20 into a working chamber (A, B, or C as shown in FIG. 1). The spring 14 shown in FIG. 2 is housed within receiving chamber 30 in piston 4, with connecting tube 42 below receiving chamber 30 providing fluid communication between receiving chamber 30 and delivery opening 20 that allows high pressure steam or compressed air 14 to pass through piston 4 and enter a working chamber as long as the proximal end of piston 4 (A, B, or C as shown in FIG. 1), as long as the proximal end of piston 4 is in fluid communication with either of the two opposed inlet ports 10 or 10'. Thus, FIG. 2 shows a piston 4 in a position below fixed valve 8 that is receiving high pressure steam or compressed air 14 from inlet port 10, while only the rotor 32 is shown in a position above fixed valve 8 with no flow of high pressure steam or compressed air 14 beyond the distal end of inlet port 10'. Furthermore, FIG. 2 identifies the extension 50 outwardly-depending from casing 6 with a through bore 52 dimensioned to receive drive shaft 38, and the center bore 40 in casing piece 6 that is used for receiving the interior end of fixed valve 8. Although not identified in FIG. 2, a center bore 40 is also formed in casing piece 6' for use in receiving the remainder of fixed valve 8. FIG. 2 further shows a fastener 60 that helps to maintain fixed valve 8 in its desired position of use and prevents its rotation, a central hole 48 in fixed valve 8, and tubing 58 connected to central hole 48 via a threaded opening 56 that provides fluid tight connection therebetween. Although not shown in FIG. 2, tubing 58 is connected to a source of high pressure steam or compressed air 14 that is shown moving through tubing 58, into the central hole 48 in fixed valve 8 and then into inlet ports 10 and 10', wherein when a piston 4 during its rotation with rotor 32 becomes aligned with inlet port 10 or 10', the high pressure steam or compressed air 14 traveling into inlet port 10 or 10' will be caused to move into piston 4 and thereafter be delivered through opening 20 into the working chamber (A, B, or C as shown in FIG. 1) that is immediately behind piston 4 as it advances toward the next approaching exhaust port 12 or 12'.

FIGS. 3, 4A, 4B, and 5 show casing pieces 6 and 6' as they would appear in the most preferred embodiment of the present invention rotary engine 2. Although not critical, in the most preferred embodiment of the present invention, it is contemplated for casing pieces 6 and 6' to be made from stainless steel. FIG. 3 shows casing piece 6 having opposed flattened areas 22 and 22' respectively adjacent to exhaust ports 12 and 12' in a position where rotating pistons 4 pass over exhaust ports 12 and 12' prior to passing over the adjacent flattened areas 22 or 22'. FIG. 3 also shows a solid circular line representing the center opening 40 through casing 6 that receives the innermost portion of fixed valve 8, and broken lines representing the extension 50 outwardly-depending from casing 6 with its through bore 52 dimensioned to receive drive shaft 38 that allows connection of the drive shaft 38 to rotor 32. FIG. 3 also shows multiple fastener holes 26 around its perimeter that are used with fasteners 26 to securely connect casing piece 6 to casing piece 6'. FIG. 3 also shows one position adjacent to each flattened area 22 and 22' where a dowel 36 is inserted for enhanced alignment and fluid tight connection of casing pieces 6 and 6' to one another. In addition, FIG. 3 shows the line G-G that defines the location where the sectional view of casing 6 shown in FIG. 5 is taken, which reveals a solid construction for casing piece 6 (which is also anticipated and preferred for the casing piece 6' used in the most preferred embodiment of the present invention rotary engine 2. In contrast, FIGS. 4A and 4B are side views respectively of casing pieces 6 and 6', which are substantially similar in configuration. FIG. 4A shows multiple fastener holes 28 through casing piece 6, a central location for fixed valve 8, the drive shaft 38 receiving extension 50 and its central bore 52, and the location of flattened area 22. FIG. 4B shows the structure of casing piece 6', with a thickened central area (unnumbered) having a central bore 40 configured and sized to receive the fixed valve 8 used to introduce air/steam 14 into the working chambers (A, B, and C shown in FIG. 1), two fasteners holes 28, and the location of flattened area 22'. The thickness of casing pieces 6 and 6' is not limited to that shown in FIGS. 3, 4A, 4B, and 5, and could vary according to the horsepower needed from rotary engine 2.

FIGS. 6 and 7 show the rotor 32 in the most preferred embodiment of the present invention rotary engine 2, with the three slots 54 that each receive a piston 4. Slots 54 are additionally marked with the designations R, S, and T in FIGS. 6 and 7 for descriptive purposes. FIG. 6 is a front view of a rotor 32 that is usable as a part of the most preferred embodiment rotary engine 2, which shows three equally spaced-apart slots 54 each used to receive a different one of the pistons 4. Broken lines through two of the slots 54 indicate the center line for that slot 54, and a double-headed arrow is provided to show a 120-degree separation between adjacent slots 54. Each slot 54 is shown to be open-ended, so that the expansion spring 18 within each piston 4 can move it beyond the perimeter surface of rotor 32 as needed during the transition from a flattened area 22 or 22' to one of the acruate lobes positioned between flattened areas 22 and 22' so as to maintain bias of the angled tip 44 of each piston 4 against the interior surface of casing pieces 6 and 6'. Circular broken line 62 represents thickened central area depending outwardly from rotor 32 that engages or depends from drive shaft 38, with the solid circular concentric line within broken line 62 representing the bore/opening 40 that receives the interior most portion of fixed valve 8 (see FIG. 7). The designations of R, S, and T are helpful in viewing FIG. 7, which is a side view of the rotor shown in FIG. 6. The thickened central area 62 is shown with broken lines that indicate the central bore 40 configured and sized to receive the interior most portion of fixed valve 8. Thickened central area 62 may be connected to a drive shaft 38, or otherwise depend from it. The positioning of inlet ports 10 and 10' are also shown in FIG. 7, in addition to the location of the open-ended three slots 54, each of which is indicated by its respective letter designation R, S, or T. The slot 54 designated by the letter T is marked in broken lines, as it is pointed away from a viewer and would otherwise be hidden in FIG. 7.

FIGS. 8-10 show more structural detail about the fixed center valve 8 in the most preferred embodiment of the present invention rotary engine 2. FIG. 8 is a front view of a fixed valve 8 that is usable as a part of rotary engine 2, with a central hole 48 used for fluid communication with a source (not shown) of high pressure steam or compressed air 14. Two opposed inlet ports 10 and 10' are in fluid communication with central hole 48 and are used to deliver steam/air 14 to rotating pistons 4. Inlet ports 10 and 10' both become widened on their distal ends, so that a sufficient amount of high pressure steam or compressed air 14 can pass through each piston 4 to achieve optimal power strokes within working chambers A, B, and C (see FIG. 1). FIG. 8 also shows an angle marked by the letter "a" that indicates the orientation needed for the inlet ports 10 and 10' relative to the flattened areas 12 and 12' of the casing pieces 6 and 6' for optimal working efficiency of the rotary engine. In the inventor's prototype, angle "a" was approximately 28-degrees, and placed the center line extending through inlet ports 10 and 10' approximately 28-degrees below a center line (not shown in FIG. 1) that would extend through casing 6 between flattened areas 22 and 22'. FIG. 9 is a side view of the fixed center valve 8 with its central hole 48 used for fluid communication with a source of high pressure steam or compressed air 14 via a tubing 58 that preferably would have a threaded connection 56 (see FIG. 2) to central hole 48 to provide a fluid tight connection therebetween. Central hole 48 is shown in FIG. 9 in substantially perpendicular orientation to and intersecting with inlet ports 10 and 10'. FIG. 10 is a front view of the fixed center valve 8 shown in FIGS. 8 and 9 and the positioning of its central hole 48 used for fluid communication with a source of high pressure steam or compressed air 14, which passes through fixed valve 8 and enters rotating pistons 4 as they become periodically aligned with inlet ports 10 and 10'. The size of central hole 48 relative to the diameter dimension of fixed valve 8 shown in FIG. 10 should not be considered as limited to that shown in FIGS. 8-10. Although not critical, in the most preferred embodiment of the present invention rotary engine 2, it is contemplated for fixed center valve 8 to be made from stainless steel.

FIGS. 11-13 show further structural detail for pistons 4 used in the most preferred embodiment of the present invention rotary engine 2. FIG. 11 is a front view of a piston 4 usable as a part of the most preferred embodiment of the present invention, which is inserted into one of the slots 54 in rotor 32. FIG. 11 shows a chamfer at the top end of piston 4 that upon start-up of rotary engine 2 reduces interference with the expansion spring 18 housed within piston 4. FIG. 11 also shows the angled tip 44 at the bottom end of each piston 4 that engages the interior wall of casing pieces 6 and 6' as the piston 4 rotates with rotor 32, with the broken line immediately above the line representing angled tip 44 indicating the rear portion of the slanted/inclined bottom surface of the piston 4 that reduces friction as piston 4 and rotor 32 rotate relative to casing pieces 6 and 6'. FIG. 11 also shows the receiving chamber 30 configured for housing expansion spring 18, a steam/air delivery opening 20 near the angled tip 44, and the connecting tube 42 providing fluid communication for high pressure steam or compressed air 14 between receiving chamber 30 and delivery opening 20. FIG. 12 is a side view of the piston 4 in the most preferred embodiment of the present invention rotated 90-degrees from the piston 4 shown in FIG. 11. FIG. 12 also shows the relative positioning of an adjacent portion of casing piece 6. The angled tip 44 at the bottom end of the piston 4 shown in FIG. 12 is in contact with the interior wall of casing piece 6, and the inclined/slanted bottom surface of piston 4 provides the angled clearance 24 from casing 6 that is identified by the number 24. In addition, FIG. 12 shows the receiving chamber 30 for housing an expansion spring 18, a steam/air delivery opening 20 near the angled tip 44, and the connecting tube 42 providing fluid communication between receiving chamber 30 and delivery opening 20. FIG. 13 is an end view of the piston shown in FIGS. 11 and 12, which shows a substantially cylindrical receiving chamber 30 for expansion spring 18, a steam/air delivery opening 20 extending away from receiving chamber 30, and the connecting tube 42 providing fluid communication between receiving chamber 30 and delivery opening 20. Although not critical, in the most preferred embodiment of the present invention, it is contemplated for expansion springs 18 housed within receiving chambers 30 to be made from stainless steel.

Although not limited thereto, examples of size dimensions possible for use in the present invention include the following. For a drive shaft 38 having a diameter dimension of approximately one inch, the flattened areas 22 and 22' on the inside of working chambers A, B, and C are expected to be approximately one inch in length dimension, with corresponding flattened areas on the outside surfaces (not assigned a reference number) of casings 6 and 6' having an approximate one-and-one-half inch length dimension. Furthermore, the anticipated diameter dimension of exhaust ports 12 and 12' is approximately one-fourth of an inch. Also, the width and thickness dimensions of the perimeter walls in casings 6 and 6' through which fasteners holes 28 having a diameter dimension of approximately nine-thirty-seconds of an inch are formed, respectively are approximately three-fourths of an inch and approximately one-half inch. Additionally, the length and width dimensions of each piston 4 respectively are approximately one-and-one-half inches and approximately one-half inch, while the length and diameter dimensions of the cylindrical receiving chamber 30 within each piston 4 used for containment of an expansion spring 18 respectively are approximately one-and-one-sixteenth of an inch and approximately three-eighths of an inch. Furthermore, the diameter dimension of the opening 20 adjacent to the angled bottom end of each piston 4 is approximately three-sixteenths of an inch, with its center approximately five-thirty seconds of an inch above angled tip 44. Furthermore, the corresponding maximum contact area of the angled tip 44 with the interior surface of casing pieces 6 and 6' is approximately 0.062 inches. In addition, (although not limited thereto) it is contemplated in the most preferred embodiment of the present invention rotary engine 2 for the fixed center valve 8 to have a length dimension of approximately one-and-one-half inch, a diameter dimension slightly less than one inch, inlet ports 10 centered at approximately three-fourths of an inch within fixed center valve 8, and the diameter dimension of the center hole 48 used for connection of tubing 58 (that is in fluid communication with a source of high pressure steam or compressed air 14) having diameter and length dimensions of approximately five-sixteenths of an inch and approximately one-and-one-eight inches. Furthermore, the corresponding height and width dimensions for widened portions of inlet ports 10 which respectively are approximately three-sixteenths of an inch and approximately five-sixteenths of an inch. Additionally, the corresponding diameter dimension of rotor 32 would be slightly larger than five inches, and the diameter dimension of each hole/bore 64 extending between a slot 54 and the center hole 40 in rotor 32 is approximately three-sixteenths of an inch Since it is also contemplated for the present invention to incorporate variations other than those shown and described herein, the scope of the present invention should be determined by the appended claims and their legal equivalents, rather than being limited to the examples given. A small and compact present invention rotary engine 2, such as disclosed hereinabove has sufficient power to run a four passenger vehicle at 80-mph, with added horsepower easily achieved for larger vehicles by increasing the width dimensions of working chambers (A, B, and C), pistons 4, each casing piece 6 and 6', and rotor 32. Although not shown in the accompanying illustrations, oil bearing access would be provided between drive shaft 38 and extension 50, as well as between drive shaft 38 and fixed valve 8.

I claim:

1. A rotary engine that is able to use high pressure steam and compressed air to produce power, said rotary engine comprising:

first and second casing pieces joined together so that a fluid tight seal is provided therebetween, said joined casing pieces together providing an interior surface with two opposed flattened areas separated from one another by two arcuate lobes, said joined casing pieces also providing two peripheral exhaust ports each located adjacent to a different one of said flattened areas;

a rotor housed for rotation between said joined casing pieces, said rotor having three equally spaced-apart slots and being configured so that said joined casing pieces fit closely around said rotor;

a drive shaft depending from said rotor so that said rotor and said drive shaft rotate together, said drive shaft extending through said first casing piece;

a valve extending centrally through said second casing piece and fixed in position so that said valve does not rotate relative to said second casing piece, said fixed valve also having a center hole that is in fluid communication with two inlet ports extending outwardly from said center hole in opposed positions from one another, each of said inlet ports further having a widened distal end configuration and an orientation that is not in alignment with either of said exhaust ports; and three pistons each secured within a different one of said slots in said rotor so that said pistons and said rotor rotate together, said pistons each having an angled tip, said pistons each also having an opening adjacent to said angled tip through which high pressure steam and compressed air used to produce power is delivered between said joined casing pieces and said rotor, said pistons also positioned within said slots so that said delivery openings in said pistons face rearwardly toward the next advancing one of said pistons, said pistons each further comprising an expansion spring that biases said angled tip against said joined casing pieces to create a reactionary force during start up of said rotary engine and also maintain said angled tip against said joined casing pieces whether one of said flattened areas or one of said lobes is encountered, wherein when a source of high pressure steam or compressed air is placed in fluid communication with said center hole in said fixed valve, high pressure steam or compressed air is delivered into the one of said pistons in fluid communication with one of said widened inlet ports, after which said high pressure steam or compressed air further travels through said delivery opening adjacent to said angled tip and between said joined casing pieces and said rotor wherein delivery causes forward movement of said rotor and pistons, with movement of the next advancing one of said pistons behind said delivering piston increasing the pressure in said delivered high pressure steam or compressed air, such that said delivering piston continues to rotate and uncovers the next adjacent one of said exhaust ports, said advancing piston behind said delivering piston then causing the high pressure steam or compressed air in front of it to travel through said uncovered exhaust port, giving a power boost to said delivering piston ahead of it, with movement of said high pressure steam or compressed air through said inlet ports and said exhaust ports continuing to provide three power strokes per one rotation of said rotor as long as said fixed valve remains in fluid communication with a source of high pressure steam or compressed air.

2. The rotary engine of claim 1 wherein said two casing pieces are joined securely together with a plurality of fasteners.

3. The rotary engine of claim 2 wherein said two casing pieces are further joined together through the use of two dowels.

4. The rotary engine of claim 3 wherein each of said dowels is positioned adjacent to a different one of said flattened areas in a position remote from the adjacent one of said exhaust ports.

5. The rotary engine of claim 1 wherein said pistons each have an approximately forty-five degree chamfer located remotely from said angled tip, with said approximately forty-five degree chamfer configured to reduce interference with said spring in said piston upon start-up of said rotary engine.

6. The rotary engine of claim 1 wherein when a center line extending through said inlet ports has a clockwise rotation of approximately twenty-eight degrees relative to said flattened areas.

7. The rotary engine of claim 1 wherein said delivery openings adjacent to said angled tips of said pistons each have a circular cross-sectional configuration.

8. The rotary engine of claim 1 wherein said casing pieces, said fixed valve, and said springs are made from stainless steel, and said rotor is made from bronze.

9. The rotary engine of claim 6 wherein said center hole in said fixed valve extends beyond said inlet ports in opposing directions.

10. The rotary engine of claim 1 wherein with said center hole in said fixed valve has a threaded opening.

11. The rotary engine of claim 1 further comprising fastening means adapted for helping to maintain said center valve in a fixed position relative to said second casing piece.

12. The rotary engine of claim 1 further comprising an approximate three-hundred-degree power stroke.

13. A method of producing power using said rotary engine of claim 1, said method comprising the steps of:

providing said rotary engine of claim 1, tubing, and a source of high pressure steam or compressed air;

securing said tubing between said central hole in said fixed valve and said source of high pressure steam or compressed air; and causing said high pressure steam or compressed air to move into said fixed valve, through said inlet ports and into a first one of said pistons, with said delivery opening in said piston releasing said high pressure steam or compressed air between said joined casing pieces and said rotor, wherein exit of said high pressure steam or compressed air from said delivery opening causes forward movement of said rotor and pistons, with movement of the next advancing one of said pistons behind said delivering piston increasing the pressure in said delivered high pressure steam or compressed air, such that said delivering piston continues to rotate and uncovers the next adjacent one of said exhaust ports, said advancing piston behind said delivering piston then causing the high pressure steam or compressed air in front of it to travel through said uncovered exhaust port, giving a power boost to said delivering piston ahead of it, with movement of said high pressure steam or compressed air through said inlet ports and said exhaust ports continuing to provide three power strokes per one rotation of said rotor as long as said fixed valve remains in fluid communication with said source of high pressure steam or compressed air.

14. The method of claim 13 wherein said two casing pieces are joined securely together with a plurality of fasteners and two dowels.

15. The method of claim 14 wherein each of said dowels is positioned adjacent to a different one of said flattened areas in a position remote from the adjacent one of said exhaust ports.

16. The method of claim 13 wherein said pistons each have an approximately forty-five degree chamfer located remotely from said angled tip, with said approximately forty-five degree chamfer configured to reduce interference with said spring in said piston upon start-up of said rotary engine.

17. The method of claim 13 wherein when a center line extending through said inlet ports has a clockwise rotation of approximately twenty-eight degrees relative to said flattened areas.

18. The method of claim 13 wherein with said center hole in said fixed valve has a threaded opening.

19. The method of claim 13 further comprising fastening means adapted for helping to maintain said center valve in a fixed position relative to said second casing piece.

20. The method of claim 13 further comprising an approximate three-hundred-degree power stroke.

* * * * *